United States Patent [19]

Bosshard

[11] Patent Number: 4,836,370

[45] Date of Patent: Jun. 6, 1989

[54] DUAL CHAMBER CONTAINER AND METHOD FOR FORMING AN OPENING BETWEEN THE CHAMBERS OF THE CONTAINER

[75] Inventor: Alexander Bosshard, Winterthur, Switzerland

[73] Assignee: Steigmühle Töss AG, Switzerland

[21] Appl. No.: 9,824

[22] Filed: Feb. 3, 1987

[30] Foreign Application Priority Data

Feb. 3, 1986 [CH] Switzerland ..... 405/86

[51] Int. Cl.[4] ..... B65D 81/32

[52] U.S. Cl. ..... 206/222; 215/10; 215/DIG. 8

[58] Field of Search ..... 206/219–222; 215/6, 10, DIG. 8; 366/602

[56] References Cited

U.S. PATENT DOCUMENTS

| | | | |
|---|---|---|---|
| 2,533,806 | 12/1950 | Holzapfel | 206/221 |
| 2,647,681 | 8/1953 | Paoli | 206/222 |
| 2,787,268 | 4/1957 | Greenspan | 215/6 |
| 3,139,121 | 6/1964 | Ballin | 206/221 |
| 3,290,017 | 12/1966 | Davies | 206/220 |
| 3,347,410 | 10/1967 | Schwartzman | 206/222 |
| 3,534,736 | 10/1970 | Meyers | 215/6 |
| 3,696,919 | 10/1972 | Miles . | |
| 3,779,372 | 12/1973 | de Lloret . | |
| 3,856,138 | 12/1974 | Mackawa et al. . | |
| 4,174,035 | 11/1979 | Wiegner . | |
| 4,221,291 | 9/1980 | Hunt . | |
| 4,264,007 | 4/1981 | Hunt | 206/222 |

FOREIGN PATENT DOCUMENTS

| | | | |
|---|---|---|---|
| 0076224 | 4/1983 | European Pat. Off. | 206/222 |
| 0096748 | 12/1983 | European Pat. Off. . | |
| 0173547 | 8/1985 | European Pat. Off. . | |
| 936486 | 12/1946 | France . | |
| 1089167 | 12/1953 | France . | |
| 1564038 | 3/1969 | France | 206/222 |
| 1192817 | 5/1970 | United Kingdom | 206/222 |
| 2012714 | 1/1979 | United Kingdom . | |

*Primary Examiner*—Jimmy G. Foster

*Attorney, Agent, or Firm*—Ostrolenk, Faber, Gerb & Soffen

[57] ABSTRACT

A container is divided into two receiving chambers by a partition wall. Each chamber houses a material, such as yogurt in one and cereal flakes in the other. The container includes structural components which will create an opening in the partition wall in response to a predetermined manipulation of the outside of the container so as to enable the material contained in the two chambers to be combined in a single chamber.

4 Claims, 4 Drawing Sheets

DUAL CHAMBER CONTAINER AND METHOD FOR FORMING AN OPENING BETWEEN THE CHAMBERS OF THE CONTAINER

BACKGROUND OF THE INVENTION

The present invention relates to a method and apparatus for providing a passageway between at least two receiving chambers located within a common container and separated by a partition wall wherein separate materials are initially located in the respective chambers and are combined in one of the chambers via a passageway formed between the two chambers in response to a predetermined manipulation of the container.

Known containers for packing materials, such as yogurt and cereal flakes, which are to be combined upon use include container arrangements in which flakes are located in an outer container into which there has been inserted an inner container containing yogurt, the inner container having a lid part which customarily consists of aluminum foil sealed to the container. Ordinarily, the inner container is merely inserted into the outer container. In order to mix the food, the consumer must remove the inner container from the outer container open the inner container by tearing open its lid part, and then empty the contents of the inner container into the outside container. This is a cumbersome procedure and is disadvantageous since it is not possible to avoid unconsumed food being left in the inner container, depending on the care and patience of the consumer. Furthermore, this container arrangement is difficult to handle.

U.S. Pat. No. 3,696,919 discloses a container arrangement having an outer container, the inside of which is divided by a cup-shaped structure arranged coaxial to the outer container to provide two receiving chambers. The cup-shaped structure which is open on top has its opening coupled to a sealing seat formed on a lid part. Its axial length is less than that of the outer container. In order to establish a passageway between the two receiving chambers, an axial crumple zone formed in the outer container is manually compressed (the outer wall of the container is highly elastic) until the lower end of the cup can be gripped with one's fingers and the cup can be withdrawn from its seat on the lid part by releasing the compressing force which had been applied to the crumple zone. This container arrangement and the method used to mix the materials contained in the two chambers is disadvantageous for various reasons.

The lid part and outer wall are expensive to manufacture, particularly if one takes into consideration the requirements of the crumple zone, resilience of the material of the wall, the outer container and the cover part. Additionally, the manipulations required to establish a passageway between the two chambers are not consumer-friendly since they can be carried out properly only with directions for use (the opening is established by manual separation of the cup from the seat on the lid part by gripping the cup through the outer wall of the container).

U.S. Pat. No. 3,856,138 discloses a dual chamber container in which an outer container, closed by a screw lid, is divided into two receiving chambers by a coaxial cylindrical partition wall. The cylindrical partition wall is open at its bottom and, in the closed condition of the container, is seated with its opening against a sealing seat on the bottom part of the outer container. When the lid is unscrewed and removed from the outer container, the opening at the bottom of the cylindrical partition wall is lifted off from the sealing lips and the materials in the two receiving chambers are combined. This structure is also costly to manufacture and requires a relatively rigid structural material be used for all of the container parts.

SUMMARY OF THE INVENTION

The present invention has as a primary object the provision of a dual chamber container which is extremely easy to utilize and is inexpensive to manufacture.

The method of the invention achieves this result by carrying out a form changing manipulation of the outer container wall which opens a passageway between the two chambers. In the preferred embodiments, the change in shape of the container is effected by indenting or bending the container wall. This is the sole manipulation required to establish the passageway between the two chambers and results in an extremely, simple, consumer-friendly manipulation.

In first, second and third embodiments of the invention, by which any resultant sealing problems are avoided and a simple construction is provided, a preformed opening is provided in the partition wall and normally closed by a sealing seat. The preformed opening is removed from the sealing seat by a predetermined manipulation of the exterior of the container so as to form a passageway between the two chambers.

In these embodiments, a foil-like lid part is coupled to an inner container and a passageway between the two chambers is opened in response to a lifting off of the lid part from the container. In this way, the manipulation required to create a passageway between the two receiving chambers is associated with a manipulation which is required to open the container itself.

In a fourth embodiment, the partition wall is torn, thereby creating a passageway between the two chambers, by tensile stressing in response to removal of the lid part from the container.

In a fifth embodiment, the partition wall is broken by the application of pressure to a region of the container's exterior wall. In this embodiment, the passageway between the two chambers is formed without the need to open the container. This is advantageous in those cases wherein the container is to be used as a shaking container to mix the materials contained in the receiving chambers before the container is opened.

In a variant on the last-mentioned embodiment, the partition wall is broken loose from the wall of the container and preferably placed in an inclined position in response to pressure applied to the outside of the container, and the passageway between the chambers is then freed upon removal of the applied pressure. In this embodiment, the opening between the chambers is obtained by breaking loose the horizontal partition wall dividing the container into upper and lower chambers from the container and placing the wall in an inclined position, preferably towards the side of the container facing away from a lid part. When the pressure applied to the container is removed, the opening between the partition wall and the container is spread apart and the material slides downward along the partition wall from the upper to the lower chamber.

The problems of the prior art are overcome in the present invention as a result of the fact that a partition wall dividing the container into two chambers is connected to the wall of the container in such a manner that a manipulation of the outer container results in a passageway being formed between the chambers through which product can move from one to the other chamber.

BRIEF DESCRIPTION OF THE DRAWINGS

The invention will be explained in further detail below, by way of example, with reference to the figures in the drawing, in which:

FIG. 7(*b*) shows, diagrammatically, a cross-sectional view through the fourth embodiment of the dual chamber container of the invention—in an open condition.

FIG. 8(*b*) shows, diagrammatically, the fifth embodiment of the dual chamber container of the invention during the opening of the connection.

FIG. 8(*c*) shows, diagrammatically, the fifth embodiment of the dual chamber container of the invention after opening of the connection.

FIG. 9(*b*) diagrammatically shows the sixth embodiment of the container arrangement of the invention during the opening of the container chamber connection.

FIG. 9(*c*) diagrammatically shows the sixth embodiment of the container arrangement of the invention after the opening of the container chamber connection.

DESCRIPTION OF THE PREFERRED EMBODIMENTS

Figure 1:
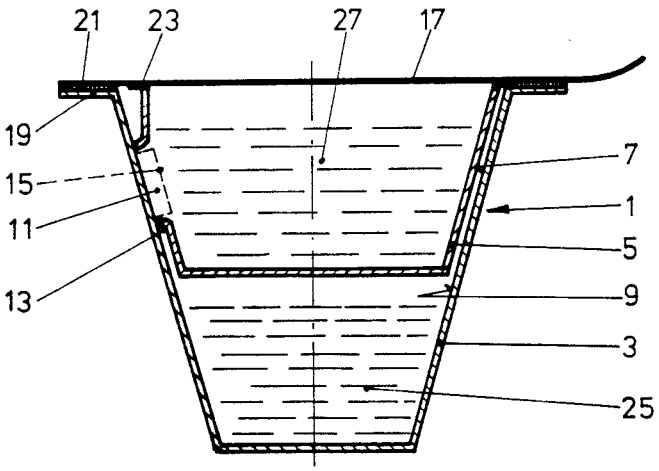
FIG. 1 is a diagrammatic longitudinal section through a first embodiment of the dual chamber container of the invention.
Figure 2:
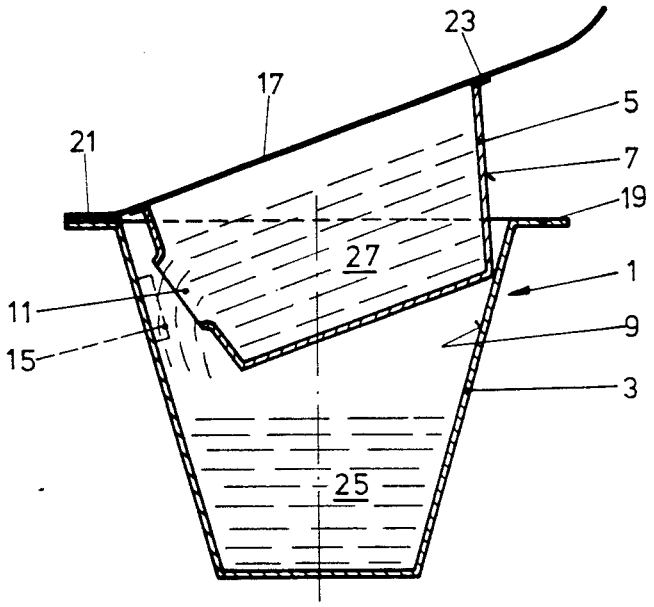
FIG. 2 shows the dual chamber container of FIG. 1 after it has been opened.
Figure 3:
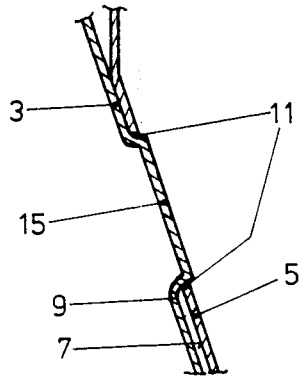
FIG. 3 shows an enlarged portion of a modification of the arrangement of FIGS. 1 and 2, with the passageway opening being shown in its closed condition.

Referring now to the drawings wherein like numerals indicate like elements, there is shown in FIGS. 1–3 a first embodiment of a dual chamber container constructed in accordance with the principles of the present invention and designated generally by the identifying character 1. Dual chamber container 1 comprises a frustoconically shaped outer container 3 into which a frustoconically shaped inner container 5 is form fit. At least one region (not shown for reasons of clarity) of the wall surface 7 of the inner container lies snugly against the wall surface 9 of the outer container 3. A preformed opening 11 is provided in the wall section 7 of the inner container 5 through which material in inner container 5 can flow into the outer container 3 when dual chamber container 1 is in the open position illustrated in FIG. 2. In the closed position of container 1, the opening 11 must be closed to prevent mixture of the materials in the two chambers. To this end, a sealing seat is provided to close opening 11. In the embodiment illustrated, the sealing seat is defined by the wall surface 9 of the outer container 3 which rests snugly against the opening 11 so as to seal the opening 11 closed. In order to improve the seal between the wall surface 9 and the passage opening 11, the wall surface 7 can be provided with resilient or elastic projections 13 at the edge region of opening 11, which projections 13 rest snugly against the wall surface 9. If desired, the wall surface 9 of the outer container can have an inward cuff 15 (FIG. 3) which rests in sealing manner in the opening 11 when the inner and outer containers 3, 5 are in the closed position shown in FIG. 1.

Container 1 includes a lid part which consists of a cover sheet 17, such as an aluminum foil, and which is connected over its entire periphery to an integrally formed collar 19 of the outer container 3. The cover sheet may be heat sealed to the outer container 3 by weld seam 21, and to the entire periphery of the inner container 5 by a weld seam 23. As a result, the sheet 17 tightly covers both the inner container 5 and the outer container 3. A first material 25 is located in the outer container 3 and a second material 27 is located in the inner container 5. The material which can be shaken easily without adhering to the container walls is preferably stored in the inner container 5 so that it can freely flow into the outer container 3 when dual chamber container 1 is placed in the open position of FIG. 2. By way of example, the material 25 in the outer container 3 may be yogurt and the material 27 in the inner container 5 may be cereal flakes.

FIG. 2 shows the container 1 in its open position when the cover sheet 17 has been partially removed from the outer container 3. In this condition, the sheet 17 has been detached from the collar 19 on one side of the outer container 3 and the connection of the weld seam 21 acts as a hinge at the opposite peripheral region. In response to the lifting of the cover sheet 17 (the predetermined manipulation of the exterior of container 1), the inner container 5 is tilted, due to the connection between the cover-sheet 17 and the inner container 5 at the weld seam 23. The tilting of inner container 5 separates opening 11 from the wall 9 of the container 3 and the material 27, such as cereal flakes, is shaken out of the opening 11 into the outer container 3 in which yogurt, for example, is located.

Figure 4:
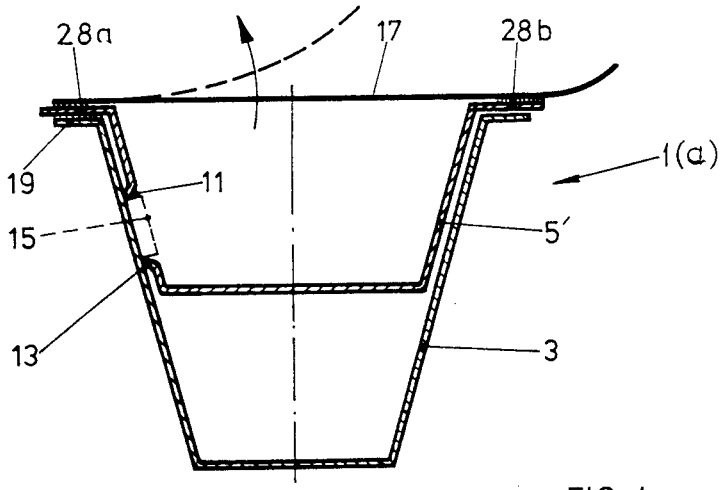
FIG. 4 is a view similar to FIG. 1 of a second embodiment of the dual chamber container of the invention.
Figure 5:
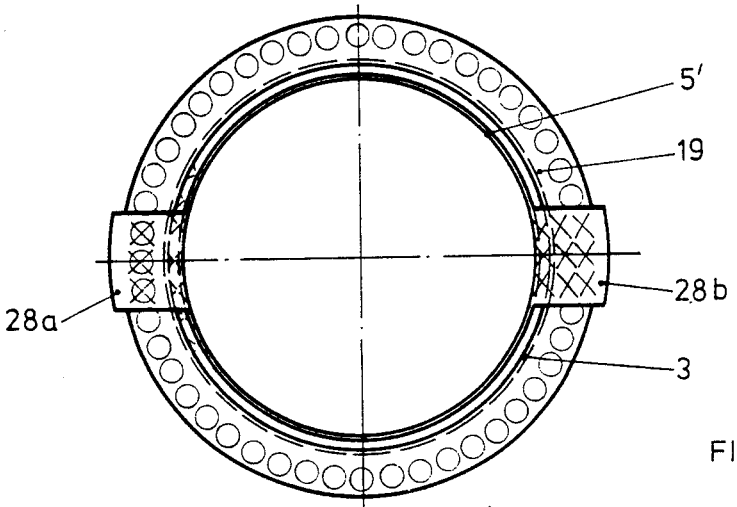
FIG. 5 is a diagrammatic top view of the arrangement of FIG. 4 serving to explain the heat sealings effected on the arrangement of FIG. 4, with the cover sheet being omitted for reasons of clarity of the drawing.

FIG. 4 shows another embodiment of the invention in which the outer container 3 is identical to the outer container 3 of FIG. 1 but the inner container 5' has been modified by the addition of two protruding tabs 28*a* and 28*b*, respectively, at its upper circumferential edge. Tabs 28*a* and 28*b* extend over the annular collar 19 of the outer container 3, as can be noted from FIG. 5. The cover sheet 17 is connected, for example heat sealed, as shown by circles for reasons of clarity of the drawing in FIG. 5, along its periphery to the collar 19 of the outer container 3. The sheet 17 is heat sealed to both the tab 28*a*, as indicated by the cross pattern in FIG. 5, and to the portion of the annular collar 19 lying below tab 28*a*. Tab 28*a* is thus connected to the sheet 17 and, with it, to the annular collar 19. The second tab 28*b* is coupled only to the cover sheet 17, as shown-by the x's in FIG.

5, which in turn is coupled to the tabs of the inner container 5', for instance heat sealed to it, but is not connected to the collar 19. As shown in dashed line in the region of the tab 28*a*, the sheet 17 can also, if necessary, be heat sealed to the entire periphery of the inner container 5'. Since the tab 28*b* is not heat sealed to the annular collar 19, it is easy to grip underneath the tab which can then be lifted off the collar 19, whereby the cover sheet 17 is torn off from the annular collar 19 (the predetermined manipulation of the exterior of the container 1(*a*)) and the inner container 5 rises together with the cover sheet 17, the tab 28(*a*) acting as a hinge.

To ensure that the interior of the outer container 3 is sealed from the environment, particularly in the region of the tab 28(*a*) and 28(*b*), the inner container 5' is lock formed (in intimate contact with) to the outer container 3. The opening 11 can cooperate with an inward cuff 13 as shown in FIG. 15.

Figure 6:
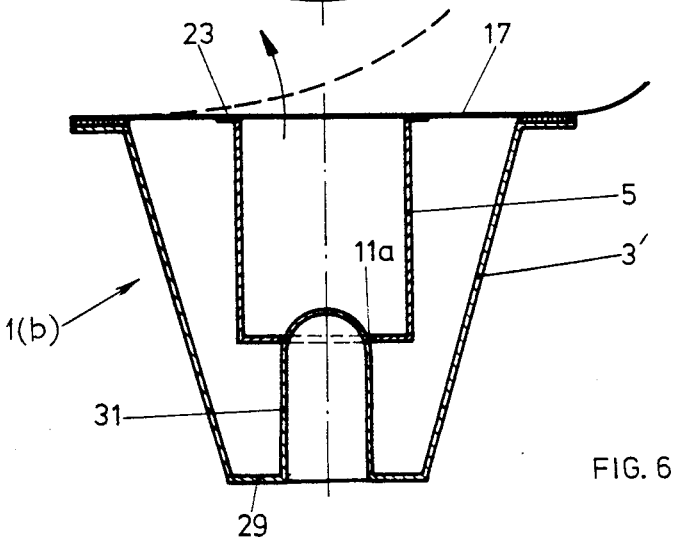
FIG. 6 is a longitudinal section through a third embodiment of the dual chamber container of the invention.

FIG. 6 diagrammatically shows a third embodiment of the invention. Based on the principles of this embodiment, a large number of variants will become apparent to those of ordinary skill in the art. In this embodiment, the outer container 3' is substantially similar to that of the embodiment of FIG. 1 but is provided on its bottom surface 29 with an inward bulge 31 (a sealing seat) which extends up in the form of a finger. The bulge 31 is preferably an integral part of the container 3'. The top of the inner container 5 is connected to the cover sheet 17, for example heat sealed, at the weld seams 23. An opening 11*a* is formed in the center of the bottom of container 5. In the closed condition of the dual chamber container 1(*b*), the finger 31 extends into the opening 11(*a*) and closes the latter tightly. Here also, what has already been stated applies with respect to the goods to be packed.

As in the embodiments of FIGS. 1–5, the opening 11(*a*) in the inner container 5 is tightly closed by interaction of inner and outer containers 3', 5 in the closed condition of the container 1(*b*), and is opened in response to a deformation of the container 1(*b*) by lifting the cover sheet which causes relative movement between inner and outer containers.

Figure 7A:
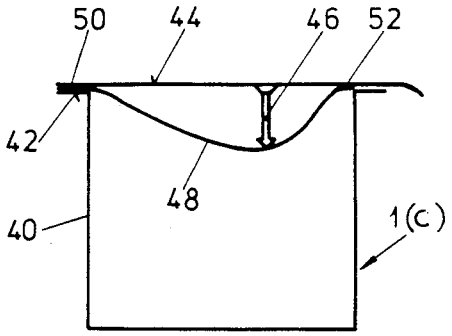
FIG. 7(*a*) shows, diagrammatically, a cross-sectional view through a fourth embodiment of the dual chamber container of the invention—in a closed condition.
Figure 7B:
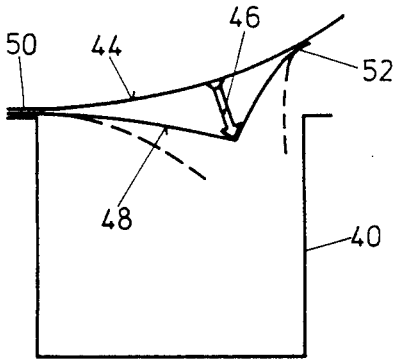

In each of the embodiments described above, the lifting of the cover sheet opens the connection between the two receiving chambers of the container. FIGS. 7(*a*) and (*b*) illustrate diagrammatically another preferred embodiment of the dual chamber container of the invention. Dual compartment container 1(*c*) includes an outside container 40 provided with a collar 42 and closed by means of a lid part 44 such as a cover sheet, which may be made of aluminum. The lid part 44 is welded at its periphery to the collar 42 of the outer container 40. A spacer member 46, preferably in the shape of a pin-like mandrel or a knife-shaped plate, protrudes downwardly from the lid part 44. A plastic foil 48 is stretched as partition wall over the spacer member 46. Foil 48 is connected at 50 on the one side of the spacer 46 to the outer container 40 and on the other side of spacer 46 at 52 solely to the lid part 44. When the lid part 44 is lifted off collar 42 and bent upward as shown in FIG. 7(*b*), the partition wall foil 48 is tensioned over the spacer member 46 and subjected to tensile stressing until, as shown in dashed lines, it tears at the portion stretched over the spacer member. As indicated by means of a pointed end of the spacer member 46, this result can be enhanced by ensuring that the edge or tip of spacer member 46 is sharp and by providing a weak place on the foil partition wall 48 in the region resting on the spacer member 46.

By the tearing of the foil partition wall 48, as indicated by dashed lines in FIG. 7(*b*), the material from the upper chamber is emptied into the receiving chamber located below said partition wall 48.

Figure 8A:
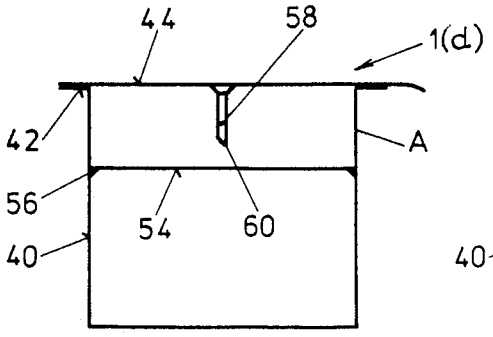
FIG. 8(*a*) shows, diagrammatically, a fifth embodiment of the dual chamber container of the invention before opening of the connection.
Figure 8B:
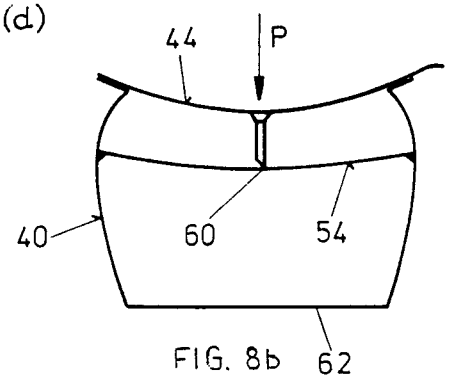
Figure 8C:
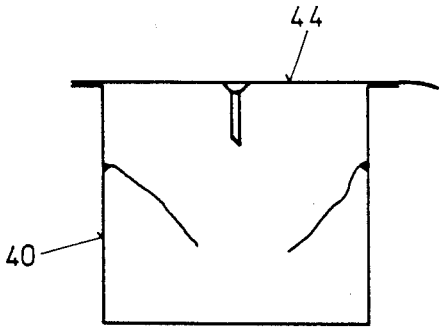

A fourth embodiment of the dual chamber container of the invention is illustrated in FIGS. 8(*a*)–8(*c*). As in the embodiment of FIGS. 7(*a*) and 7(*b*), the dual chamber container 1(*d*) of FIGS. 8(*a*)–8(*c*) includes outer container 40 which is close by a sheet-shaped lid part 44 which may be heat sealed to the collar 42 of container 40. A foil-like partition wall 54 is connected (for example heat sealed) at its periphery at 56 to the inner wall of the outer container 40, and lies relatively taut in the transverse plane of the outer container 40, subdividing the latter into two receiving chambers. A puncture mandrel 58 is fastened to the lid part 44 and has a point 60 which faces the partition wall 54. The outer container 40 is formed of a resilient material, at least in an upper region A. To form an opening between the two receiving chambers, pressure, as indicated by the arrow P (FIG. 8(*b*)), is exerted on the lid part 44 causing the lid part to be pushed inward under elastic deformation of the wall of the outer container in the region A. If the bottom portion 62 of the outer container 40 is relatively dimensionally rigid, the foil partition wall 54 is additionally stressed thereby. It is essential, however, that the point 60 of the mandrel 58 be pressed against the foil partition wall 44 and perforate the latter when the lid part 44 is pressed downwardly so that when the pressure P is removed the outer container 40 with lid part 44 snaps back into its original shape. The two receiving chambers will then be connected together, as shown in FIG. 8(*c*). The snapping back of the wall of the outer container 40 causes the opening formed in partition wall 44 to open further. In this embodiment, the outer container 40 remains closed even after the opening between the receiving chambers has been formed, so that the container can then be shaken to mix the now combined materials from the two receiving chambers. Thereafter, the lid part 44 may be removed and the contents of container 40 may be accessed.

Figure 9A:
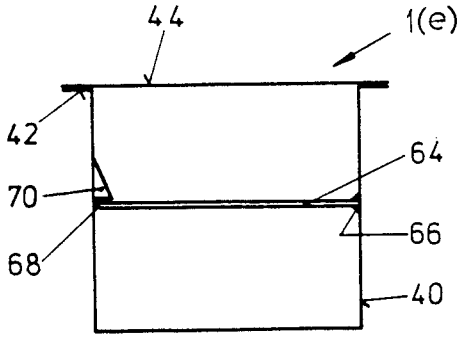
FIG. 9(*a*) diagrammatically shows a sixth embodiment of the container arrangement of the invention before the opening of the container chamber connection.
Figure 9B:
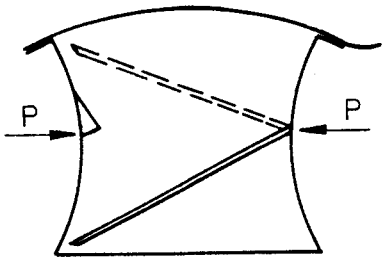
Figure 9C:
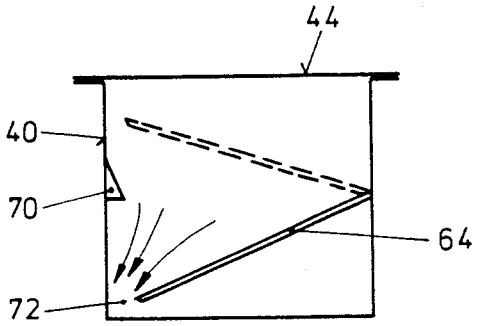

FIGS. 9(*a*)–9(*c*) show a fifth embodiment of the invention wherein the dual chamber container 1(*e*) also remains closed after the opening has been formed between the two internal chambers. In this embodiment, dual chamber container 1(*e*) includes a container 40, which is closed by a sheet-shaped lid part 44 similar to that of FIGS. 7(*a*)–(*b*) and 8(*a*)–(*c*). Container 1(*e*) is divided into two receiving chambers by a relatively dimensionally rigid partition wall 64. The partition wall 64 is rigidly attached (as indicated at 66) to the inner wall of outer container 40 along a circumferential region, which is preferably smaller than half the total circumference of outer container 40. Over the remainder of the circumference it is connected via an intended breaking place 68. In the region of the intended braking place 68, above the partition wall 64, an inwardly extending protrusion 70 is formed on the inner wall of the outer container 40. If the container 1(*e*) is pushed together as shown in FIG. 9(*b*), as indicated by arrows P, then as a result of the relatively dimensional rigidity of the partition wall 64, the wall 64 breaks loose at its intended breaking point and is inclined upward or downward by the guiding action of the outer container wall, as shown. The protrusion 70 is provided if a downward direction of inclination is preferred. If the pressure P is now removed, then the container rapidly returns to the position illustrated in FIG. 9(*c*), partition wall remains in the inclined position previously assumed and an opening 72 is formed between the upper and lower receiving chambers. A downward inclination of the partition wall 64 is preferred so that the material stored above the partition wall tends to slide downward under the force of gravity.

The dual chamber container shown and described above assures, with the simplest of manipulations, that a connection between the two receiving chambers provided and is excellently suited for the packing of yogurt and cereal flakes or similar products or two-component substances such two-component component adhesives or lacquers, etc., the components of which are to be stored separately before use and combined upon use.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

I claim:

1. A dual container comprising:

an outer container and an inner container, said inner container having a surrounding said partition wall; and a preformed opening in said partition wall, a sealing seat which forms part of said container, and said seat being placed for normally closing said opening and wherein said sealing seat is removed from said opening so as to form a passageway;

said inner and said outer container having open tops;

a foil like lid coupled to said partition wall in such a manner that said preformed opening is removed from said sealing seat and said passageway is formed in said partition wall in response to the at least partial removal of said lid from said container, said tops of said containers are both normally coupled to said foil like lid to close each of said containers, and wherein said inner container with said partition wall remains fully coupled to said lid when said lid is at least partially removed from said outer container.

2. The container of claim 1, wherein said sealing seat is formed on a sidewall of said outer container adjacent said preformed opening.

3. A method comprising:

providing a container which includes an outer container and an inner container, the walls of said inner container defining a partition wall separating said outer and said inner containers; said container including structural components which will form a passageway between said outer and said inner containers in response to a predetermined deformation of the exterior of said outer container;

said partition wall having a preformed opening that is normally closed by a sealing seat which forms part of said container;

said container including a foil like lid which is coupled to said partition wall of said inner container; said inner and said outer containers are both open at their tops and are both normally coupled to said foil like lid to close each of said containers;

the further step of deforming said exterior of said container in said predetermined manner comprising at least partially removing said lid from said container for causing said structure components to form said passageway between said inner and outer containers by removing said preformed opening from said sealing seat for forming said passageway in said partition wall between said inner and outer containers in response to the at least partial removal of said lid from said container, said inner container remains fully coupled to said lid during said deforming step.

4. The method of claim 3, wherein sealing seat is formed on a side wall of said outer container adjacent said preformed opening.

* * * * *